US008902125B1

(12) United States Patent
Robbins et al.

(10) Patent No.: US 8,902,125 B1
(45) Date of Patent: Dec. 2, 2014

(54) RECONFIGURABLE HANDHELD DEVICE

(75) Inventors: Steven J. Robbins, West Linn, OR (US); Francois Raynal, San Jose, CA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 447 days.

(21) Appl. No.: 13/249,023

(22) Filed: Sep. 29, 2011

(51) Int. Cl.
*G09G 5/00* (2006.01)

(52) U.S. Cl.
USPC ..... 345/1.1; 345/3.1; 349/13; 353/39; 455/566

(58) Field of Classification Search
CPC ..... G02B 2027/0134; G02B 2027/0174; G02B 27/0093; G02B 27/0103; G02B 27/225; G02B 5/1828; G06T 19/006
USPC ..... 345/1.1–3.4, 204; 353/39; 349/13; 455/566
See application file for complete search history.

(56) References Cited

U.S. PATENT DOCUMENTS 6,085,112 A * 7/2000 Kleinschmidt et al. .... 455/556.1
6,489,934 B1 * 12/2002 Klausner ..... 345/1.1
6,791,773 B2 * 9/2004 Nagaoka ..... 359/833
7,016,704 B2 * 3/2006 Pallakoff ..... 455/566
8,132,920 B2 * 3/2012 Li et al. ..... 353/33
8,233,204 B1 * 7/2012 Robbins et al. ..... 359/15
2002/0113912 A1 * 8/2002 Wright et al. ..... 349/13

OTHER PUBLICATIONS

U.S. Appl. No. 12/571,262, filed Sep. 30, 2009, Robbins et al.
MicroDAGR, accessed from http://www.rockwellcollins.com/~/media/Files/Unsecure/Products/Product%20Brochures/Navigation%20and%20Guidance/GPS%20Devices/MicroDAGR%20data%20sheet.aspx at least as early as Sep. 28, 2011, Rockwell Collins, 2 pages.

* cited by examiner

*Primary Examiner* — Amare Mengistu
*Assistant Examiner* — Gloryvid Figueroa-Gibson
(74) *Attorney, Agent, or Firm* — Angel N. Gerdzhikov; Donna P. Suchy; Daniel M. Barbieri

(57) ABSTRACT

A reconfigurable handheld device includes a housing; a processor disposed within the housing; and a display system coupled to the processor and including a display area. The display system is configured to selectively provide one of a first image viewable via the display system at a normal viewing distance; a second image viewable via the display system proximate at least one eye of a user; and a third image generated by the display system and viewable via a remote surface.

14 Claims, 6 Drawing Sheets

RECONFIGURABLE HANDHELD DEVICE

BACKGROUND

The present disclosure relates generally to the field of reconfigurable handheld devices, and more specifically, to a reconfigurable handheld device that provides multiple display modes for users.

Conventional devices such as laptops or personal digital assistants (PDAs) have many drawbacks in terms of providing displays to users. As such, various embodiments disclosed herein are directed to reconfigurable handheld devices or other mobile devices that provide improved display functionality and multiple display options to users of such handheld and other mobile devices.

SUMMARY

One embodiment relates to a reconfigurable handheld device comprising a housing; a processor disposed within the housing; and a display system coupled to the processor and comprising a display area, the display system configured to selectively provide one of a first image viewable via the display system at a normal viewing distance; a second image viewable via the display system proximate at least one eye of a user; and a third image generated by the display system and viewable via a remote surface.

Another embodiment relates to a method of reconfiguring a handheld device, the method comprising receiving an input via an input device of the handheld device; selectively providing one of a first image, a second image, and a third image via a display system of the handheld device based on the input; wherein the first image is viewable via the display system at a normal viewing distance; wherein the second image is viewable via the display system proximate at least one eye of a user; and wherein the third image is viewable via a remote surface.

Another embodiment relates to a handheld device comprising a housing; a processor disposed within the housing; a display system coupled to the processor and disposed at least partially within the housing, the display system comprising: a first light source comprising one of an LED, OLED, and an LCD; and a second light source comprising a microprojector; and a substrate waveguide disposed over at least a portion of both the first and second light sources; wherein the display system is configured to selectively provide one of a first real image based on light provided by the first light source; a second virtual image based on light provided by the second light source and directed through the substrate waveguide; and a third remote image based on light received from the second light source and projected onto a remote surface by the microprojector.

DETAILED DESCRIPTION OF EXEMPLARY EMBODIMENTS

Figure 1:
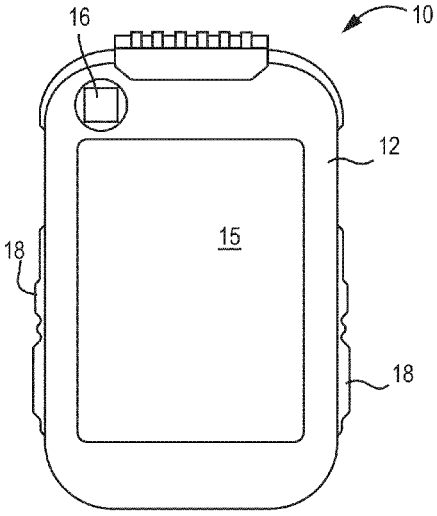
FIG. 1 is a perspective view of a handheld device according to an exemplary embodiment.

Referring to FIG. 1, a handheld device is shown according to an exemplary embodiment as device 10. The teachings herein can extend to a wide variety of handheld or other mobile devices, such as a personal digital assistant (PDA), smartphone, mobile telephone, personal navigation device (e.g., a GPS receiver), etc. In some embodiments, device 10 is a smartphone, and includes mobile telephony and PDA functionality (e.g., personal data applications such as email, electronic calendar, contacts, etc., word processing, spreadsheets, etc.). In some embodiments, device 10 is configured to be usable while held in the hand of a user.

Figure 2:
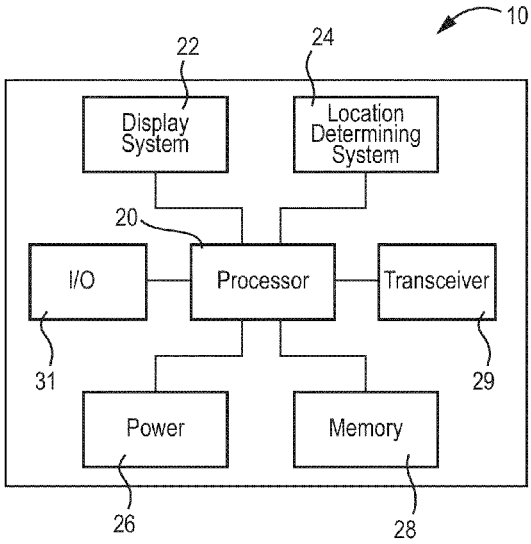
FIG. 2 is a schematic representation of the handheld device of FIG. 1 according to an exemplary embodiment.
Figure 3:
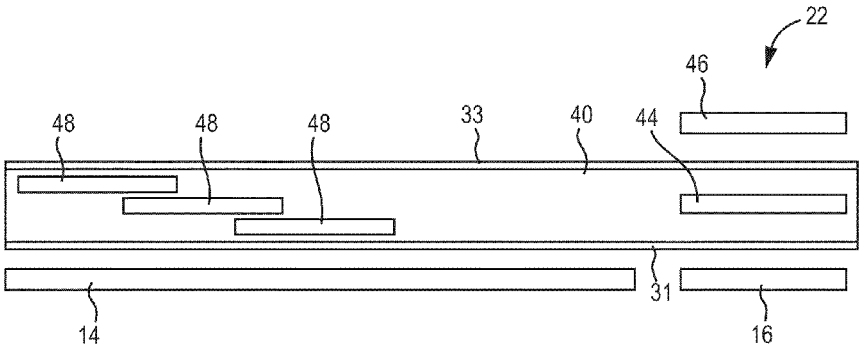
FIG. 3 is a schematic representation of a display system of the handheld device of FIG. 1 according to an exemplary embodiment.
Figure 4:
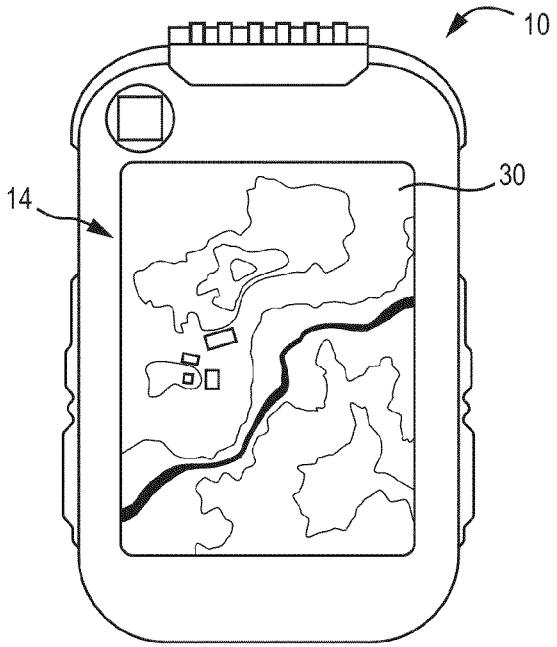
FIG. 4 is a front view of the handheld device of FIG. 1 being used in a first display mode according to an exemplary embodiment.
Figure 5:
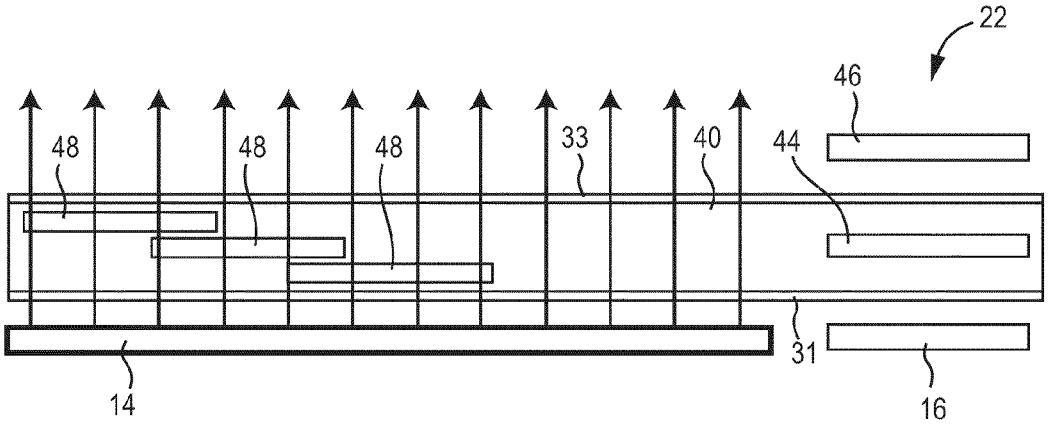
FIG. 5 is a schematic representation of the display system of FIG. 3 being used in the first display mode according to an exemplary embodiment.

As shown in FIGS. 1-3, according to an exemplary embodiment device 10 includes a housing 12, a display area 15, and one or more input buttons 18. While buttons 18 are generally shown as being provided on the lateral sides of device 10, more or fewer buttons may be utilized, and the size, shape, and placement of button(s) 18 may be varied. For example, in addition to or instead of buttons 18 shown in FIG. 1, one or more buttons may be provided on a front surface of device 10, a back surface of device 10, integrated into a touchscreen display, etc.

Referring to FIG. 2, device 10 includes a processor 20, a display system 22, a location determining system 24, a power source 26, memory 28, transceiver 29, and input/output devices 31. Processor 20 controls the operation of display system 22 based on inputs received from a user and/or a variety of other factors. More or fewer components than those shown in FIG. 2 may be provided as part of device 10 according to various exemplary embodiments, and components may be combined or separated into discreet components rather than being in the specific configuration shown in FIG. 2.

Referring now to FIG. 2, display system 22 is shown in greater detail according to an exemplary embodiment. Generally, display system 22 is usable to provide users with one or more images or displays (e.g., a map, navigation instructions, a compass, a camera/video recorder viewer/videoconferencing, and the like), such that users may view data/information included in the one or more images. Display system 22 includes a first light source 14, a second light source 16, a waveguide 40, and an optical component or lens 46. It is understood that display system 22 may include more or fewer components than those shown in FIG. 2, and the components of display system 22 may be arranged in a variety of ways.

According to an exemplary embodiment, first light source 14 is a display component (e.g., a light emitting diode (LED) display, a liquid crystal display (LCD), an organic LED (OLED), etc.) and is configured to provide real images to users of device 10 (e.g., images similar to those provide by conventional smartphones and similar devices). According to an exemplary embodiment, first light source 14 provides a viewable display approximately the size of display area 15 shown in FIG. 1. In one embodiment, display area 15 may be generally square or rectangular in shape and approximately 2 inches wide by 3 inches long. According to various other embodiments, display area 15 may be other sizes and shapes (e.g., 2 in. by 2 in., etc.).

In some embodiments, second light source 16 comprises a microprojector (e.g., a picoprojector, microdisplay, etc.) and is configured to emit light toward waveguide 40. In one embodiment, second light source 16 includes a display area of approximately 0.2 inches (e.g., 5 mm) square, while in other embodiments second light source 16 may include a larger or smaller display area. In some embodiments, second light source 16 provides an image that is of substantially higher definition than first light source 14. In one embodiment, second light source 16 may comprise a liquid crystal on silicon (LCOS) display component (e.g., a 5 mm SVGA LCOS, etc.), while in other embodiments, other types of light sources may be utilized, such as an LED, OLED, LCD, and the like. Second light source may include components such as a laser light source, beam splitter, collimator, and other optical components to provide suitable light to waveguide 40.

According to an exemplary embodiment, waveguide 40 comprises a generally planar substrate and a plurality of diffractive components. Waveguide 40 may be made of a substantially transparent and/or translucent optical material (e.g., glass, polymer, etc.), and may be a reflective waveguide, a diffractive waveguide, or another suitable type of waveguide. Waveguide 40 is disposed at least partially within housing 12 such that waveguide 40 covers at least a portion of first light source 14 and at least a portion of second light source 16. Waveguide 40 is configured to receive light from second light source 16 (e.g., collimated light from a laser, etc.)

In some embodiments, waveguide 40 comprises a first layer 33 (e.g., a first optical plastic, glass, or other substantially transparent layer) and a second layer 33 (e.g., a second optical plastic, glass, or other substantially transparent layer) and one or more diffraction gratings 44, 48 (e.g., diffractive gratings, beam splitters, combinations thereof, etc.) disposed therebetween. Diffraction gratings 44, 48 may be or include a reflection hologram, a Bragg grating, a switchable Bragg grating, or another surface grating or diffractive component. An exemplary waveguide and related optical components are shown and described in U.S. patent application Ser. No. 12/571,262, filed Sep. 30, 2009, the content of which is incorporated herein by reference in its entirety.

Grating 44 receives light provided by second light source 16. In some embodiments, grating 44 is a switchable diffractive grating and is switchable between a first mode, where grating 44 permits light to pass through grating 44 without diffraction, and a second mode, where grating 44 diffracts light received from second light source 16 through waveguide 40. Gratings 44, 48 may similarly be switchable gratings such gratings 48 are switchable between a first mode, where gratings 48 permit light from first light source to pass through gratings 48 without diffraction, and a second mode, where gratings 48 diffract light passing within waveguide 48 and diffract the light out of waveguide 40.

Optical component 46 may be or include an optical lens and be made from an optical plastic, glass, or other suitable material. Component 46 may receive light from second light source 16 (e.g., when waveguide 40 is not diffracting light) and refract the light provided from second light source 16 in a divergent manner such that the light transmitted by component 46 is suitable for projection onto a remote surface. As such, in combination with second light source 16, component 46 enables a user to project images generated by second light source 16 onto remote surfaces such as projector screens, walls, or other flat or otherwise suitable surfaces. It should be understood that other optical components may be utilized instead of or in combination with optical component 46 to provide the remote projection features of device 10.

Referring now to FIGS. 4-12, various configurations of device 10, and more specifically, display system 22, are shown according to various embodiments. Device 10 is a reconfigurable handheld device, such that depending on the particular situation, device 10 provides users with various display options. For example, according to an exemplary embodiment, display system 22 is configured to selectively provide one of three different types of images, or displays. In some embodiments, the display type is selected based on an input received from a user via one or more input devices of device 10 (e.g., a button, a voice recognition system, a touch-sensitive input device, etc.). In some embodiments, a dedicated display selection button (e.g., a toggle-type input button, etc.) may be provided such that a particular display mode is utilized based on the position of the button. It should be understood that for purposes of illustration, terms such as "first" image, "second" image," "third" image, and the like are used herein to differentiate between different display configurations. Such terms are not to be construed as limiting, and the order of the images may be rearranged from that shown herein according to various alternative embodiments.

A first image 30 (see FIGS. 4-5) may be provided based on light emitted by first light source 14. As discussed above, first light source 14 may be or include an LED, OLED, LCD, or any other suitable display or light source. Light emitted by first light source 14 travels through waveguide 40 substantially unobstructed and provides an image viewable at a normal viewing distance (e.g., at arm's length, approximately 12 inches, 16 inches, or another suitable distance). As such, first light source 14 provides a real image having the size of display area 15 shown in FIG. 1 that is viewable at a normal viewing distance.

Figure 6:
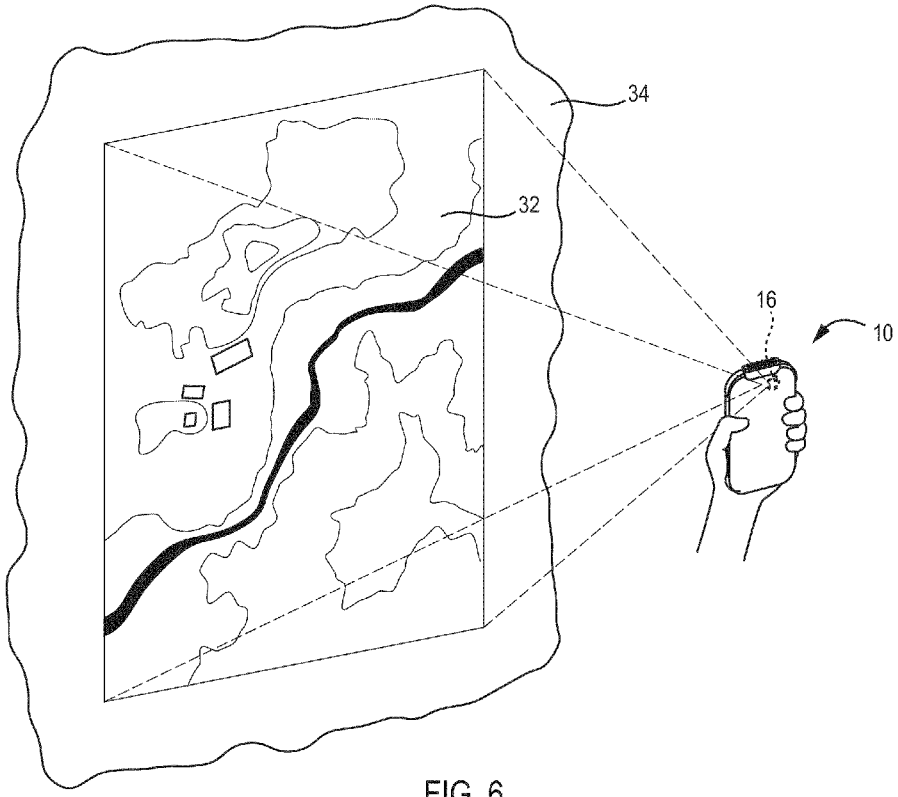
FIG. 6 is a perspective view of the handheld device of FIG. 1 being used in a second display mode according to an exemplary embodiment.
Figure 7:
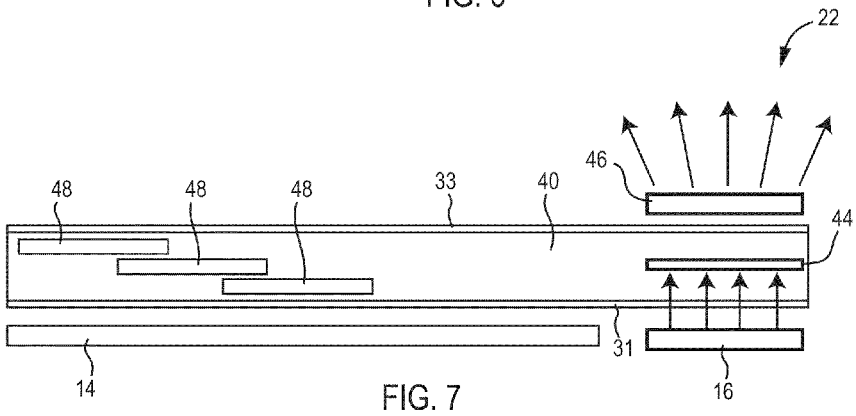
FIGS. 7-8 are schematic representations of the display system of FIG. 3 being used in the second display mode according to an exemplary embodiment.
Figure 8:
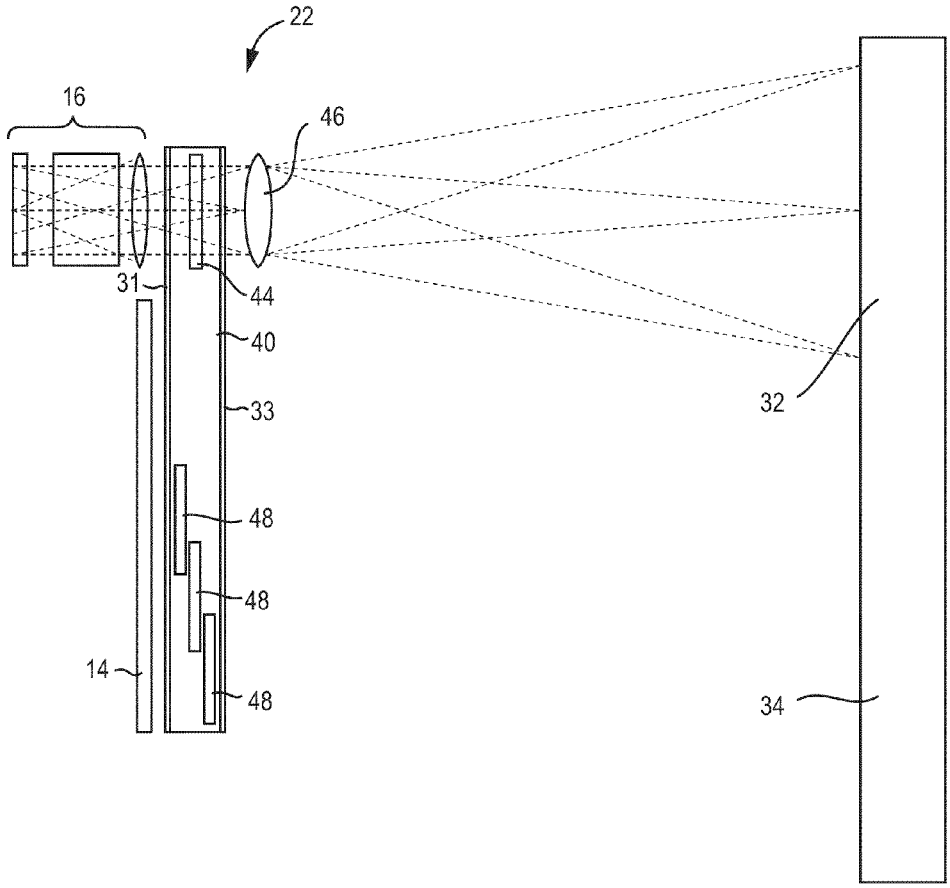

A second image 32 (see FIGS. 6-8) may be provided utilizing second light source 16 and permitting light emitting from second light source 16 to travel substantially unobstructed through waveguide 40 and though optical component 46 (see FIG. 7). As shown in FIGS. 6 and 8, light emitting from optical component 46 may be projected onto a remote surface 34 to provide second image 32. Because second light source 16 may provide a relatively high resolution beam of light, second image 32 may have satisfactory resolution even when projecting second image 32 across considerable distances (e.g., 5 feet, 10 feet, etc.). As such, second light source 16 provides light that is projected onto a remote surface to provide a real image display on the remote surface.

Figure 12:
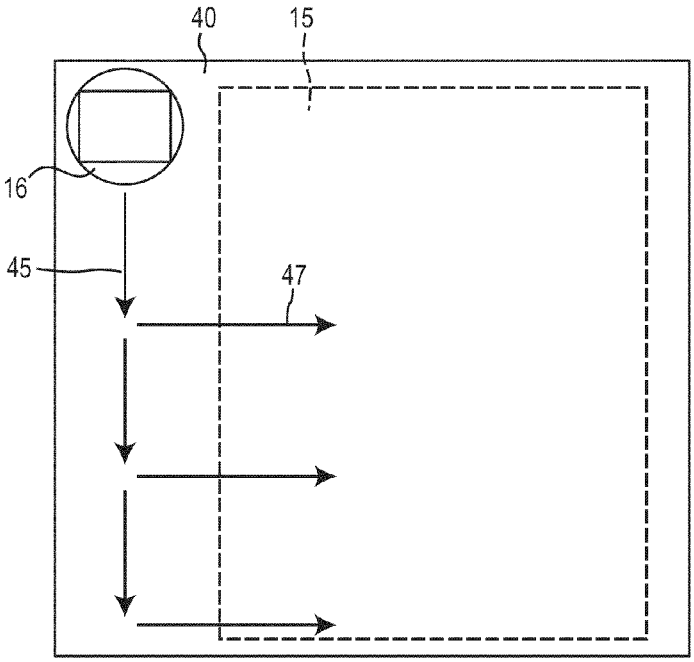

A third image 36 (see FIGS. 9-11) may be provided by display system 22 by utilizing second light source 16 and waveguide 40. In this situation, first light source 14 may be turned "off" such that first light source 14 emits no or very little light. Waveguide 40 may be enabled such that light emitted by second light source 16 is diffracted by diffraction grating 44 and directed into waveguide 40. As shown in FIG. 12, diffraction gratings 44, 48 may act as an "exit pupil expander" such that the exit pupil of wave guide 40 is substantially larger than the entrance pupil of waveguide 40.

For example, the entrance pupil of waveguide 40 may be approximately 0.2 inches square. Light is diffracted in the direction of arrow 45 and subsequently in the direction of arrow 47 shown in FIG. 12 by way of the optical components (gratings, beam splitters, beam shapers, high gain diffusers, etc.) within and optical characteristics of waveguide 40. As such, the exit pupil of the light exiting waveguide 40 may be 2 inches square or larger (e.g., 2 inches by 3 inches, 3 inches by 3 inches, etc.). Diffraction gratings 48 diffract the light within waveguide 40 to exit waveguide 40 such that waveguide 40 and viewing area 15 act as a "near to eye display." In one embodiment, the size of the exit pupil of waveguide 40 is a function of the size of diffraction gratings 48. Diffraction gratings 48 are configured such that no "gaps" appear in the exit pupil.

Figure 9:
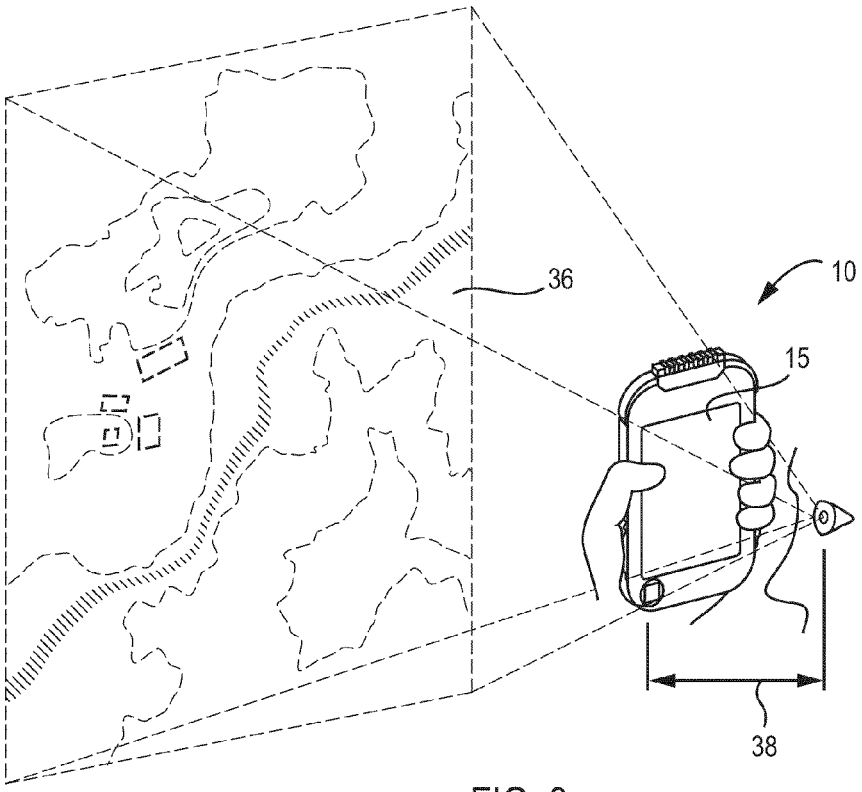
FIG. 9 is a perspective view of the handheld device of FIG. 1 being used in a third display mode according to an exemplary embodiment.
Figure 10:
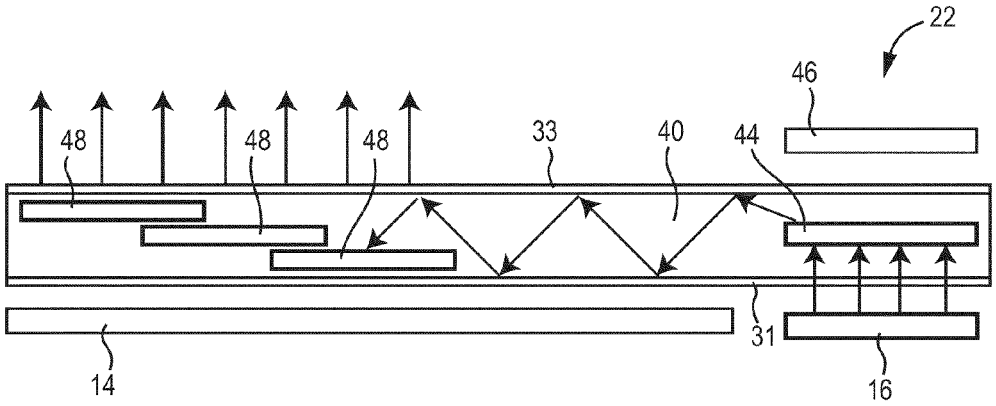
FIGS. 10-12 are schematic representations of the display system of FIG. 3 being used in a third display mode according to an exemplary embodiment.
Figure 11:
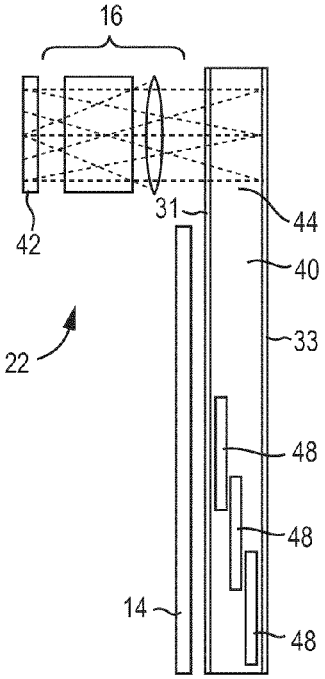

As shown in FIG. 9, third image 36 is viewable by a user by placing viewing area 15 proximate (e.g., within 1-3 inches) of a user's eye. Third image 36 may be viewable in a monocular (single eye) or binocular (two eye) fashion. Third image 36 is a virtual image (e.g., a switchable, collimated, magnified image) that appears to be "behind" (from the user's perspective) device 10 and is enlarged (e.g., 4 times or more) relative to the size of display area 15. Rather than a user holding device 10 at a normal viewing distance and viewing a real image via display area 15 (as described with respect to FIGS. 4-5), a user rather holds device 10, for example, 1-3 inches from one or both eyes and is provided with a relatively larger virtual image that may appear, for example, four times or more larger than viewing area 15 at a normal viewing distance. In some embodiments, the near to eye display feature may provide a wide/panoramic view of the image. For example, an image provided by first light source 14 via display area 15 may subtend an angle of approximately 11 degrees (e.g., a 50 mm display viewed at a 250 mm viewing distance), while an image provided by waveguide 40 may subtend an angle of 40 degrees or more and appear to be magnified by four times or more (e.g., similar to a laptop display viewed at arm's length).

Reconfigurable display 10 may provide various advantages relative to more conventional devices. For example, providing larger images (either projected or via a near-to-eye display) may improve readability issues, eliminate and/or reduce web browsing/viewing difficulties, and facilitating map interaction by reducing the need to "move" around web pages/maps, zoom in/out frequently, etc. Further, device 10 provides three different viewing modes (e.g., standard, near-to-eye, and projection) in a single device, eliminating the need for users to carry individual devices dedicated to various types of viewing modes. Device 10 may further be a ruggedized device (e.g., with a ruggedized housing, display system, and/or other components) suitable for military or similar use. As such, device 10 provides a compact/stealth means for sharing information with, for example, other soldiers, etc.

Referring back to FIG. 2, certain components of device 10 will be described in greater detail. Processor 20 may provide computing/processing operations for device 10, including controlling the operation of display system 22, transmitting and receiving wireless communications (e.g., voice, data, cellular communications, etc.) via transceiver 29, and executing various application/system programs such as telephone applications, email/instant-messaging applications, web browsing/Internet connectivity, determining the location of device 10 (e.g., in coordination with location determining system 24), and so on.

Location determining system 24 may include a global positioning system (GPS) configured to provide a user with a current location of device 10. According to various alternative embodiments, other location determining techniques in addition to or rather than GPS may be utilized. Power Source 26 may include any suitable power source, including a removeable/rechargeable battery, a power interface to receive power from a remote power source, and so on. Memory 28 may include or be implemented using any machine/computer-readable media capable of storing data and may include volatile memory, non-volatile memory, removable memory (e.g., a removable memory card, etc.), nonremovable memory, and the like.

Transceiver 29 may be configured to communicate in a variety of different communication modes/protocols, including cellular communications, WWAN, WLAN, WIFI (IEEE 802.11x), infrared, Bluetooth, and the like. Input/Output devices 31 may include a variety of input buttons, audio/visual inputs/outputs, and the like. For example, devices 31 may include a microphone, a speaker, a vibrator, etc. to receive/provide inputs/outputs to and from users of device 10.

Figure 13:
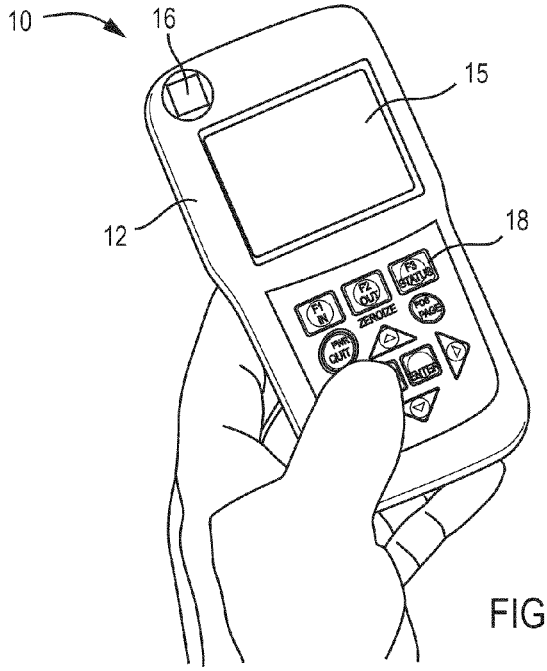
FIG. 13 is a perspective view of a handheld device according to an alternative exemplary embodiment.

Device 10 may include a wide variety of devices, including the Defense Advanced GPS Receiver (DAGR) and/or microDAGR devices provided by Rockwell Collins, Inc., and numerous other cellular phones, smartphones, PDAs, and similar handheld and mobile devices. For example, referring to FIG. 13, device 10 is shown according to an alternative embodiment, and may include a plurality of input buttons 18 provided below a display area 15 on the front face of device 10. Numerous other configurations for device 10 may be used according to various other embodiments. All such devices are understood to be within the scope of the present disclosure.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is important to note that the construction and arrangement of the elements of the reconfigurable handheld device as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the embodiments. Accordingly, all such modifications are intended to be included within the scope of the present disclosure as defined in the appended claims. The order or sequence of any process or method steps may be varied or re-sequenced according to alternative embodiments. Other substitutions, modifications, changes, and/or omissions may be made in the design, operating conditions, and arrangement of the exemplary embodiments without departing from the spirit of the present disclosure.

What is claimed is:

1. A reconfigurable handheld device comprising:

a housing;

a processor disposed within the housing; and a display system coupled to the processor and comprising a display area, the display system configured to selectively provide one of:

a first image viewable via the display system at a normal viewing distance;

a second virtual image viewable via the display system proximate at least one eye of a user; and a third image generated by the display system and viewable via a remote surface;

wherein the display system further comprises:

a first light source usable to generate the first image and a second light source usable to generate the second and third images, wherein the second light source comprises a microprojector; and a waveguide configured to receive light from the microprojector and provide the third image.

2. The device of claim 1, wherein the first light source comprises one of a light emitting diode (LED), an organic LED (OLED), and a liquid crystal display (LCD).

3. The device of claim 1, wherein the waveguide comprises a substantially transparent substrate and a plurality of diffractive gratings.

4. The device of claim 3, wherein the plurality of diffractive gratings comprises at least one switchable diffractive grating configured to receive light from the microprojector, the switchable diffractive grating switchable between a first mode wherein the display system provides the second image and a second mode wherein the display system provides the third image.

5. The device of claim 1, wherein the first image has a first size and the second image has a second size substantially larger than the first size.

6. The device of claim 1, further comprising an input device coupled to the processor and configured to receive an input from a user, wherein the processor is configured to cause the display system to selectively provide one of the first, second, and third image based on the input.

7. A method of reconfiguring a handheld device, the method comprising:

receiving an input via an input device of the handheld device;

selectively providing one of a first image, a second image, and a third image via a display system of the handheld device based on the input, wherein providing the second image comprises directing light from a second light source through a waveguide and wherein the second light source comprises a microprojector;

wherein the first image is viewable via the display system at a normal viewing distance;

wherein the second image is a virtual image viewable via the display system proximate at least one eye of a user; and wherein the third image is viewable via a remote surface;

wherein the waveguide comprises a substantially transparent substrate and a plurality of diffractive gratings; and wherein the plurality of diffractive gratings comprises at least one switchable diffractive grating configured to receive light from the microprojector, the switchable diffractive grating switchable between a first mode wherein the display system provides the second image and a second mode wherein the display system provides the third image.

8. The method of claim 7 wherein providing the first image comprises providing the first image from a first light source;

wherein providing the third image comprises projecting light from the second light source onto the remote surface.

9. The method of claim 8, wherein the first light source comprises one of a light emitting diode (LED), an organic LED (OLED), and a liquid crystal display (LCD).

10. The method of claim 8, wherein the first image has a first size and the second image has a second size substantially larger than the first size.

11. A handheld device comprising:

a housing;

a processor disposed within the housing; and a display system coupled to the processor and disposed at least partially within the housing, the display system comprising:

a first light source comprising one of an LED, OLED, and an LCD;

a second light source comprising a microprojector; and a substrate waveguide disposed over at least a portion of both the first and second light sources;

wherein the display system is configured to selectively provide one of a first real image based on light provided by the first light source; a second virtual image based on light provided by the second light source and directed through the substrate waveguide; and a third remote image based on light received from the second light source and projected onto a remote surface by the microprojector.

12. The handheld device of claim 11, wherein the processor is configured to direct the display system to selectively provide one of the first, second, and third images based on an input received from a user.

13. The handheld device of claim 11, wherein the waveguide comprises a switchable diffraction component switchable between a first mode wherein the display system provides the second image and a second mode wherein the display system provides the third image.

14. The handheld device of claim 11, further comprising cellular telephone electronics configured to provide cellular communications between the handheld device and other devices.

* * * * *